US006916198B2

(12) United States Patent
Wu et al.

(10) Patent No.: US 6,916,198 B2
(45) Date of Patent: Jul. 12, 2005

(54) CABLE CONNECTOR HAVING IMPROVED CROSS-TALK SUPRESSING FEATURE

(75) Inventors: Jerry Wu, Irvine, CA (US); Yin-Tse Kao, La Miranda, CA (US); An-Jen Yang, Irvine, CA (US); Yuan-Chieh Lin, Lake Forest, CA (US); Jim Xin Zhao, Mission Viejo, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/771,487

(22) Filed: Feb. 3, 2004

(65) Prior Publication Data

US 2004/0157492 A1 Aug. 12, 2004

Related U.S. Application Data

(63) Continuation of application No. 10/264,650, filed on Oct. 3, 2002, now Pat. No. 6,685,501.

(51) Int. Cl.[7] ..... H01R 12/24
(52) U.S. Cl. ..... 439/497; 439/607
(58) Field of Search ..... 439/497, 607, 439/579

(56) References Cited

U.S. PATENT DOCUMENTS 5,281,762 A * 1/1994 Long et al. ..... 174/78
6,380,485 B1 * 4/2002 Beaman et al. ..... 174/88 R
6,489,563 B1 * 12/2002 Zhao et al. ..... 174/88 C
6,582,252 B1 * 6/2003 Lin ..... 439/610
6,582,255 B2 * 6/2003 Simmons et al. ..... 439/701

* cited by examiner

*Primary Examiner*—Michael C. Zarroli
(74) *Attorney, Agent, or Firm*—Wei Te Chung

(57) ABSTRACT

A high speed cable connector (1) includes a cover (10), a base (80) and a cable assembly (30) mounted between the cover and the base. The cable assembly includes a cable (42) consisting of a plurality of lines (44). Each line has a signal pair (47, 48) and a ground conductor (492). The signal pair includes a pair of upper and lower signal conductors (472, 482). The ground conductors are soldered to shielding plates (50). The shielding plates are soldered to top and bottom faces of a rear end of a printed circuit board (PCB) (62). The upper and lower signal conductors of each signal pair are soldered to the top and bottom faces of the rear end of the PCB, respectively, and located between two neighboring shielding plates, whereby cross-talk and interference between two neighboring signal pairs can be effectively suppressed and reduced. The PCB has a front end electrically connecting with contacts (662) for electrically engaging with a complementary connector. The cable connector further has latches (88) for latching with the complementary connector, and a pull tab (82) for releasing the latching when the pull tab is pulled.

4 Claims, 7 Drawing Sheets

CABLE CONNECTOR HAVING IMPROVED CROSS-TALK SUPRESSING FEATURE

CROSS-REFERENCE TO RELATED APPLICATION

This application is a continuation application of a application Ser. No. 10/264,650, filed on Oct. 3, 2002, (now U.S. Pat. No. 6,685,501), which was a application of U.S. patent application Ser. No. 10/217,636 (now U.S. Pat. No. 6,641,425) entitled ELECTRICAL CONNECTOR HAVING A LATCH MECHANISM, invented by Jerry Wu, filed on Aug. 10, 2002, and assigned to the same assignee of this application. The disclosure of the co-pending application is wholly incorporated herein by reference.

BACKGROUND OF THE INVENTION

1. Field of the Invention

The present invention relates to a cable connector, and particularly to a high speed cable connector for use in InfiniBand™ application.

2. Description of Related Art

Following the popularity of the Internet, information access speed becomes an important issue. Although the information processing speed of a central process unit (CPU) of a data processing machine, i.e., a computer or a server, is increased enormously, information processing speed of I/O port devices of the machine is still relatively low, which results in that information still can not be accessed by the machine from the Internet with a speed as quickly as expected.

To solve this problem, an InfiniBand™ I/O port structure is proposed, which offers three levels of link performance—2.5 Gbits, 10 Gbits and 30 Gbits/sec. An electrical connector for use in such high speed application always confronts a problem of cross-talk. Cross-talk means interference of signals of neighboring signal lines.

U.S. Pat. No. 6,394,839 B2 (the '839 patent) disclosed a high speed cable connector which has two lines 12*a*, 12*b* each include a signal pair 20 and a ground conductor 18. The ground conductors 18 are connected to a shorting bar 50 which has a first portion 52 located between the signal pairs to improve the problem of cross-talk therebetween.

The structure disclosed by the '839 patent still cannot overcome the problem of cross-talk occurred in an electrical connector for InfiniBand™ architecture since it must transmit and process information and data at an even higher speed.

Thus, an improved shielding structure which can effectively reduce cross-talk between signal pairs of a cable connector for InfiniBand™ application is required.

SUMMARY OF THE INVENTION

Accordingly, an object of the present invention is to provide a high speed cable connector wherein cross-talk between neighboring signal pairs at an end of a cable connecting with a connector can be effectively reduced and suppressed.

In order to achieve the object set forth, a high speed cable connector for InfiniBand™ application includes a cover and a base both made by die casting of aluminum alloy, and a cable assembly mounted between the cover and the base. The cable assembly includes a cable consisting of a plurality of lines. Each line has a pair of signal conductors and a ground conductor. The ground conductors are soldered to shielding plates which are in turn soldered to a rear end of a printed circuit board. Each signal pair includes an upper and a lower signal conductor which are soldered to top and bottom faces of the rear end of the printed circuit board, and located between two neighboring shielding plates. The shielding plates extend in a vertical direction which is perpendicular to a horizontal direction in which the printed circuit board extends. The printed circuit board has a front end fixed to a rear end of an insulative body which has a forwardly extending tongue. Contacts are received in top and bottom faces of the tongue. The contacts are used for electrically engaging with a complementary connector. The contacts each have a rear end soldering to the front end of the printed circuit board. A pair of latches is mounted on lateral sides of the base near a front end thereof. The latches are used for latching with the complementary connector when it mates with the cable connector in accordance with the present invention. The cable connector further comprises a pull tab movably mounted therein. When the pull tab is pulled rearwards, driving blocks formed on the pull tab push the latches laterally outwardly to causes the lathes to release their latching from the complementary connector.

Other objects, advantages and novel features of the invention will become more apparent from the following detailed description when taken in conjunction with the accompanying drawings.

DETAILED DESCRIPTION OF THE INVENTION

Figure 1:
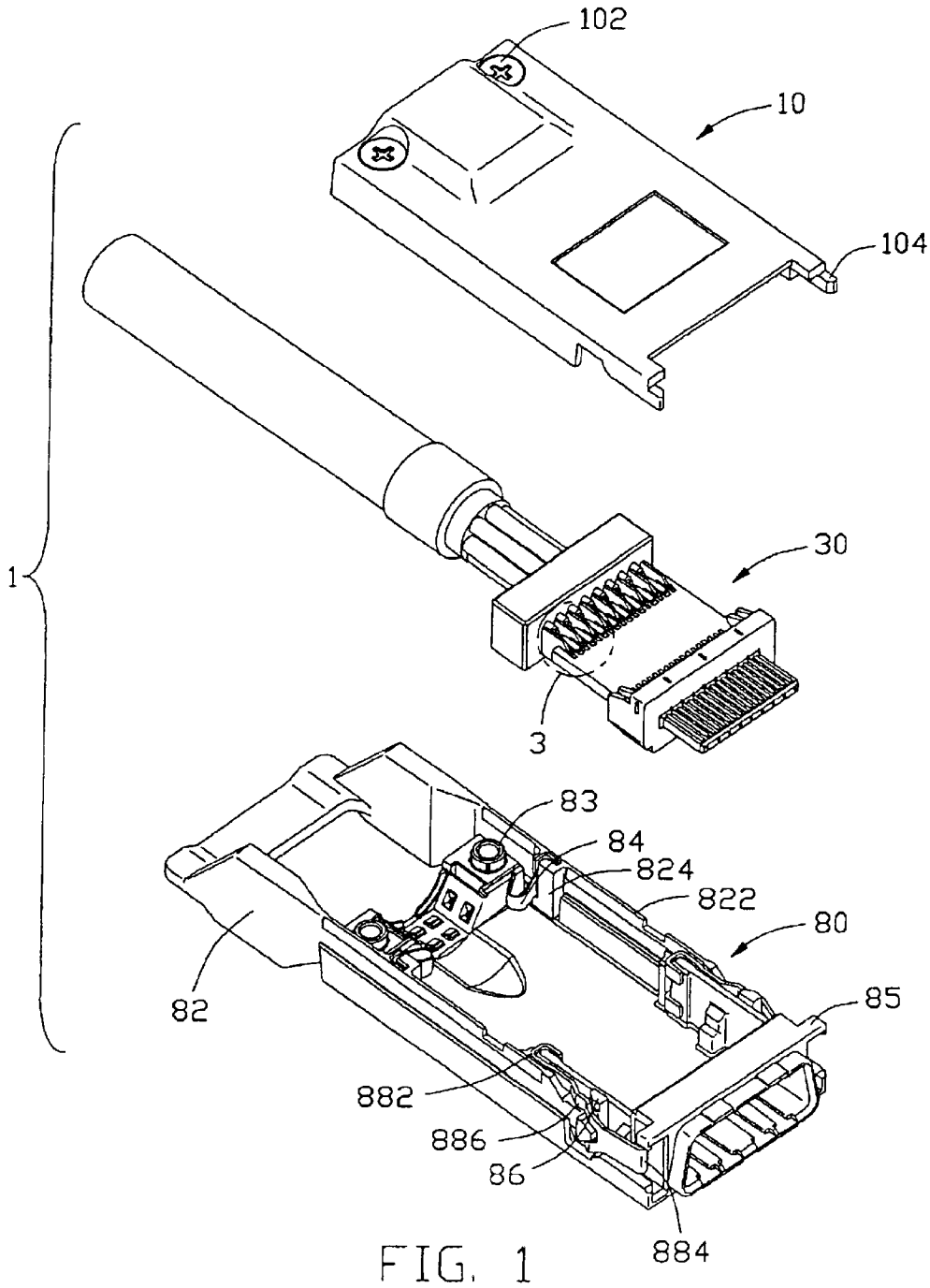
FIG. 1 is a perspective, exploded view of a cable connector for use in an InfiniBand™ application in accordance with the present invention.

Reference will now be made to the drawing figures to describe the present invention in detail.

Referring to FIG. 1, a cable connector 1 for use in an InfiniBand™ application in accordance the present invention comprises a cover 10, a cable assembly 30 and a base 80. Both the cover 10 and base 80 are formed by die casting of metal such as aluminum alloy. The cover 10 is provided with screws 102 for screwing into screw holes (not labeled) defined in studs 83 formed in the base 80 after the cable assembly 30 is put in the base 80 to thereby assemble the cover 10, the cable assembly 30 and the base 80 together. To mount the cover 10 to the base 80, firstly protrusions 104 formed on a front end of the cover 10 are positioned below side flanges 85 formed on a front end of the base 80, respectively. Then a rear end of the cover 10 on which the screws 102 are located is pivoted downwardly about the flanges 85 toward the base 80 until the rear end of the cover 10 is in contact with a rear end of the base 80. The cable connector 1 is further provided with a pull tab 82 movably mounted between the cover 10 and base 80 for releasing a latch between the cable connector 1 and a complementary connector. Regarding this detailed illustrations are given below.

Figure 2:
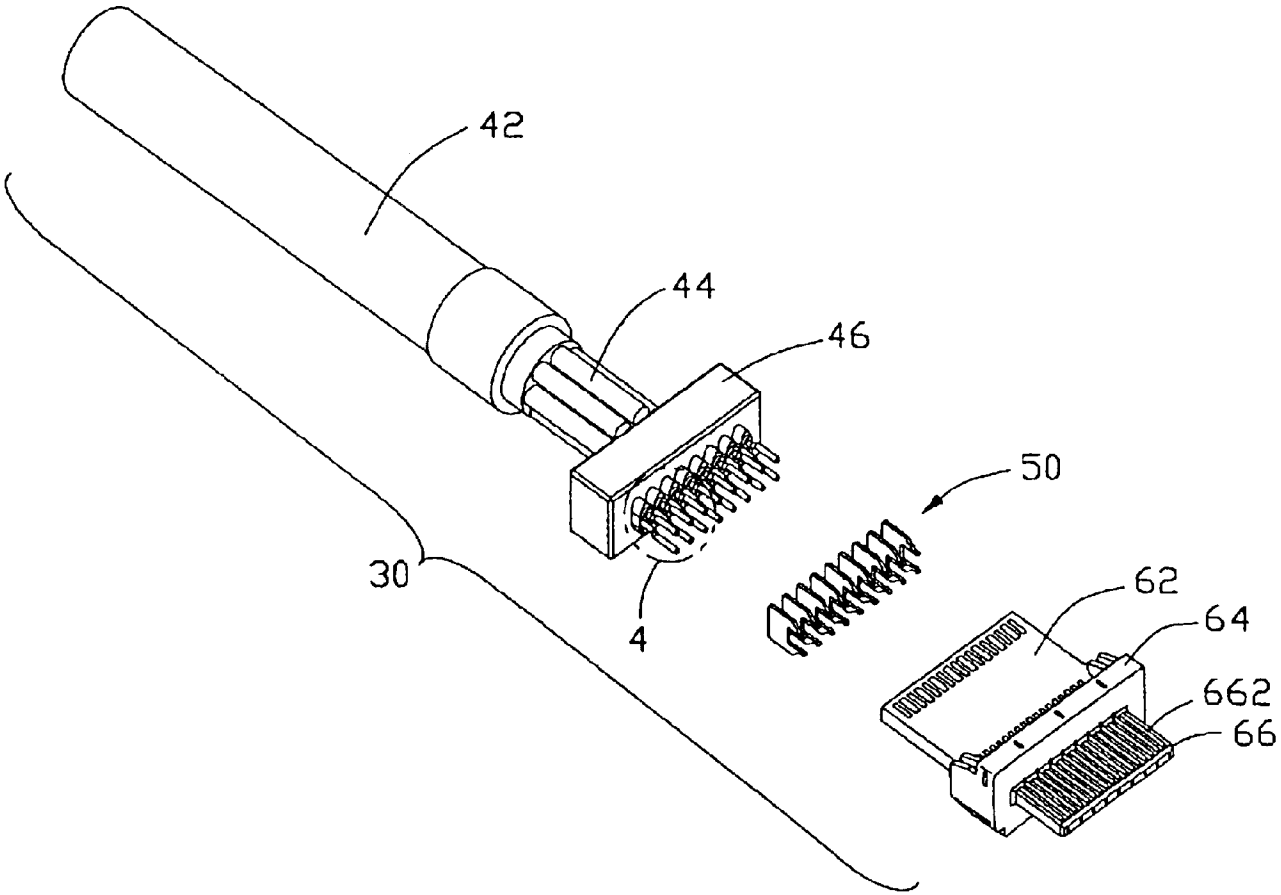
FIG. 2 is a perspective, exploded view of a cable assembly of the cable connector in accordance with the present invention.
Figure 3:
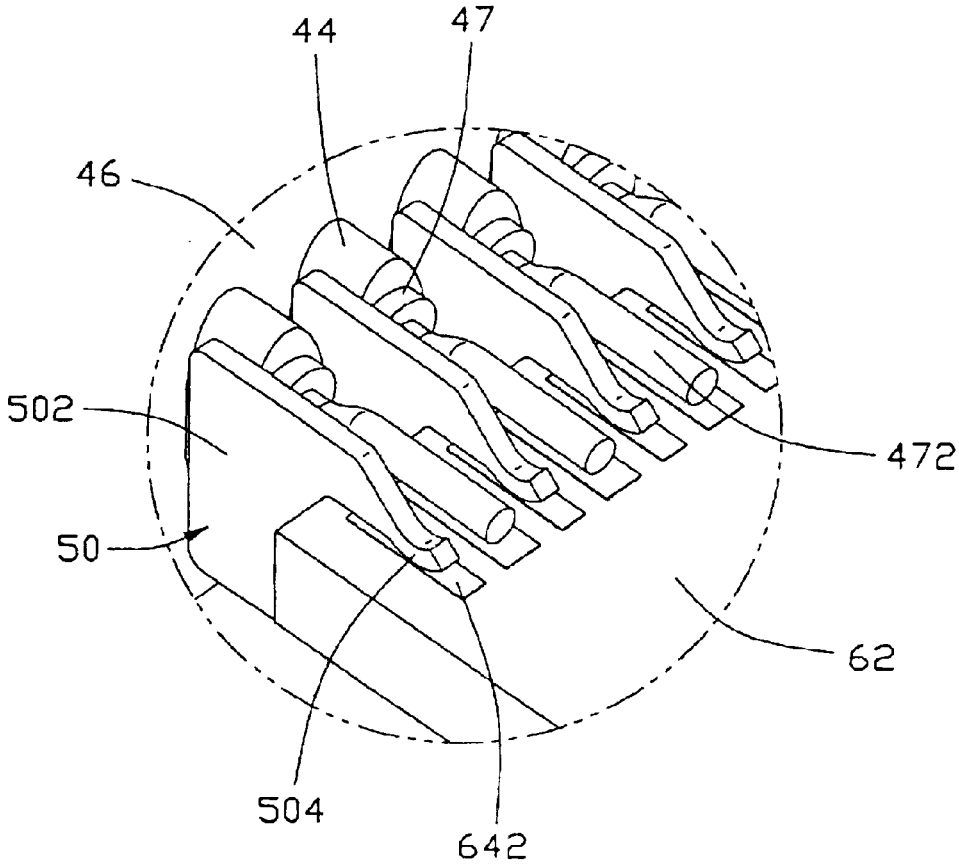
FIG. 3 is an enlarged view of a circled portion of FIG. 1 indicated by reference number 3 thereof.
Figure 4:
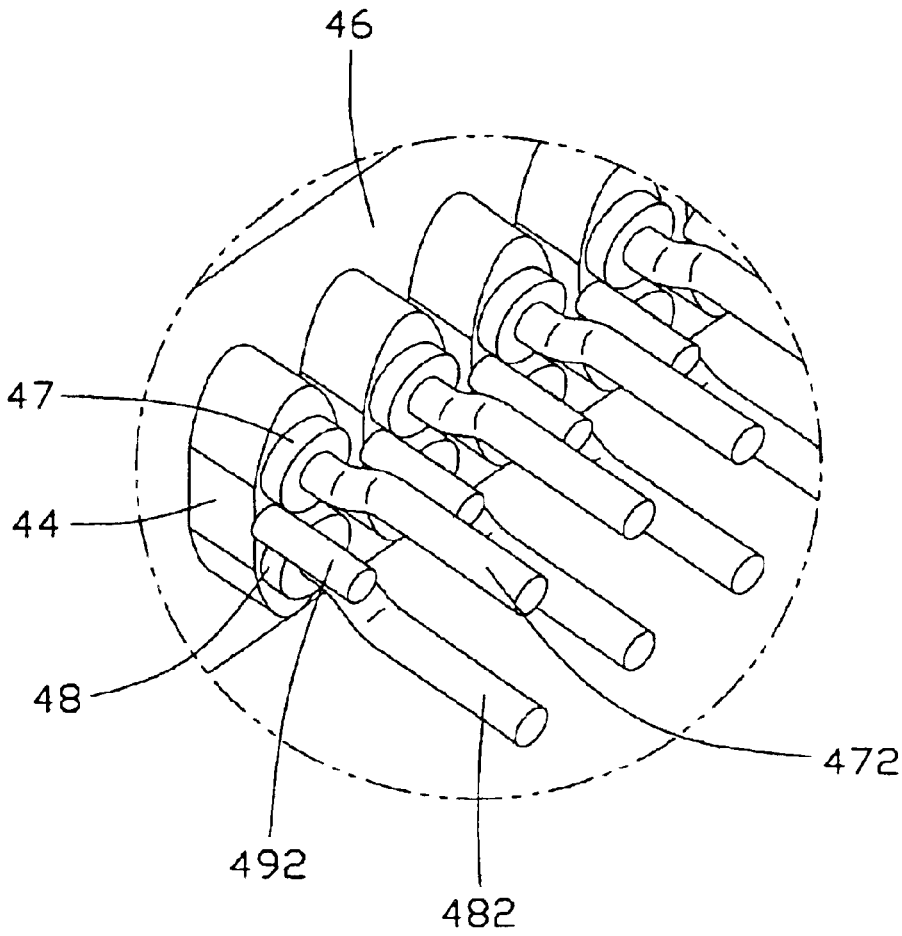
FIG. 4 is an enlarged view of a circled portion of FIG. 2 indicated by reference number 4 thereof.

Referring to FIG. 2, the cable assembly 30 includes a cable 42 accommodating eight lines 44 therein, a spacer 46 fixedly connecting front ends of the eight lines 44 in an equally spaced relationship, eight shielding plates 50, a printed circuit board (PCB) 62, an insulative body 64 having a rear end to which a front end of the PCB 62 is secured and a tongue 66 extending forwardly. The front ends of the lines 44 are arranged to laterally extend in the spacer 46. A plurality of contacts 662 is received in top and bottom faces (not labeled) of the tongue 66 for electrically connecting with the complementary connector. Each contact 662 has a rear end soldering to the front end of the PCB 62. The spacer 46 is insert molded to the front ends of the lines 44 to connect therewith, and has a cuboidal configuration.

Referring to FIGS. 3, 4, 7 and 9, each line 44 includes a signal pair 47, 48 and a ground conductor 492. The signal pair 47, 48 includes signal conductors 472, 482, respectively. Each shielding plate 50 includes a body portion 502 and bifurcated upper and lower fingers 504, 506. The fingers 504, 506 are curved toward each other. The signal conductors 472, 482 of the signal pair 47, 48 of each line 44 are so arranged that they are vertically aligned with each other. The ground conductor 492 of each line 44 is located between and at a left side of the signal pair 47, 48 thereof, as viewed from FIG. 4.

In assembling the cable assembly 30, the rear ends of the contacts 662 are soldered to solder pads 622 (FIG. 5) on the front end of the PCB 62. The ground conductors 492 are then soldered to the body portions 502 of the shielding plates 50, respectively. The shielding plates 50 and the signal conductors 472, 482 are soldered to solder pads 642 on a rear end of the PCB 62 in which the upper fingers 504 of the shielding plates 50 are soldered to the solder pads 642 on a top face of the PCB 62 while the lower fingers 506 are soldered to the solder pads 642 on a bottom face of the PCB 62. The shielding plates 50 are so located that a pair of vertically aligned solder pads 642 respectively on the top and bottom faces of the rear end of the PCB 62 is located between two neighboring shielding plates 50. The signal conductor 472 of each signal pair 47, 48 is soldered to a corresponding solder pad 642 on the top face of the PCB 62 between two corresponding neighboring shielding plates 50, and the signal conductor 482 is soldered to a corresponding solder pad 642 on the bottom face of the PCB 62 between the two corresponding neighboring shielding plates 50. The ground conductors 492 and the signal conductors 472, 482 are electrically connected to the contacts 662 via circuitry (not shown) of the PCB 62. The body portion 502 of each shielding plate 50 has a front edge tightly abutting against a rear edge of the PCB 62. The shielding plates 50 each have a length larger then a length of the signal conductors 472, 482 exposed to environment. Furthermore, the body portion 502 extends in a vertical direction which is perpendicular to a horizontal extension direction of the PCB 62, and has a height larger than a vertical distance between the signal conductors 472, 482 of a corresponding signal pair 47, 48. Moreover, the fingers 504, 506 extend on the PCB 62 a length which is substantially the same as that the signal conductors 472, 482. Thus, neighboring signal pairs are sufficiently shielded from each other by a corresponding shielding plate therebetween. Accordingly, interference and cross-talk between the neighboring signal pairs can be effectively suppressed and eliminated by the corresponding shielding plate therebetween.

Figure 5:
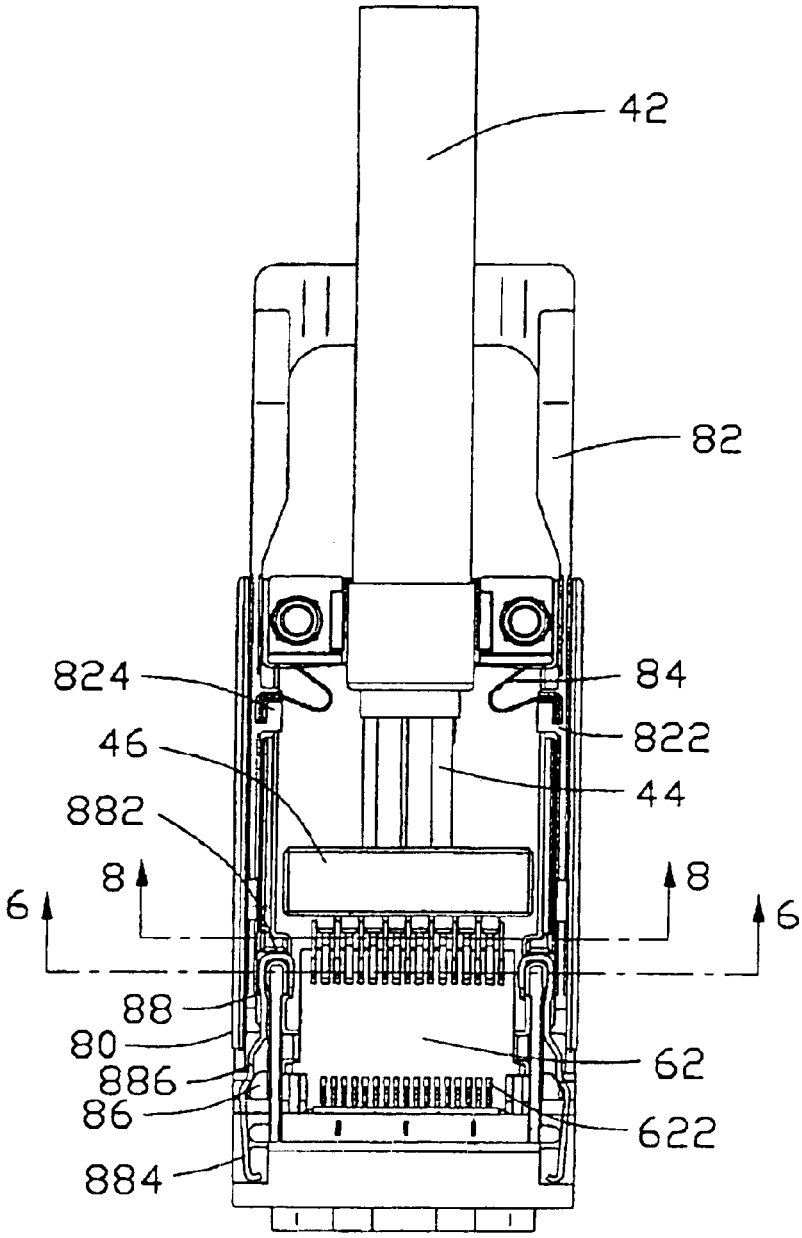
FIG. 5 is top view showing the cable assembly of FIG. 2 mounted in a base of the cable connector in accordance with the present invention.
Figure 6:
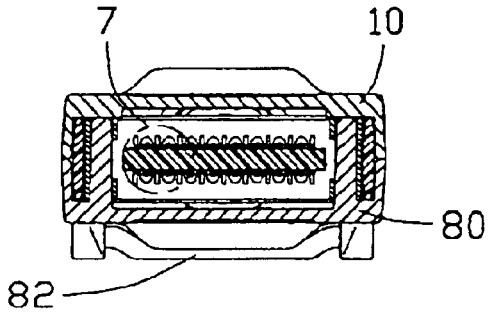
FIG. 6 is a cross-sectional view taken along line 6—6 of FIG. 5.
Figure 7:
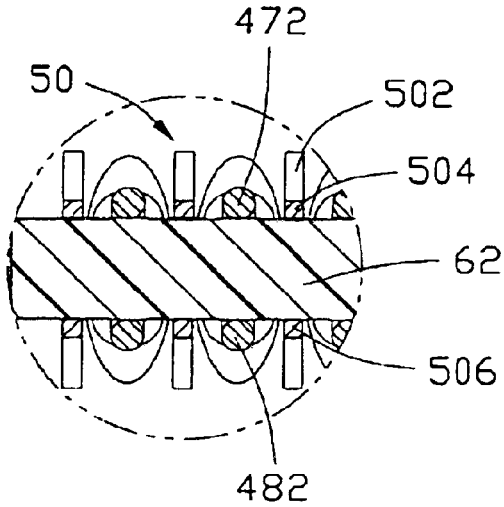
FIG. 7 is an enlarged view of a circled portion of FIG. 6 indicated by reference number 7 thereof.
Figure 8:
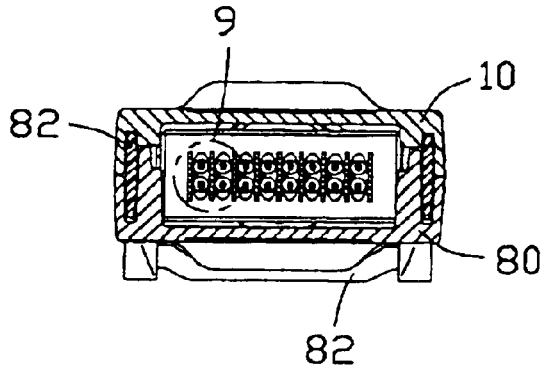
FIG. 8 is a cross-sectional view taken along line 8—8 of FIG. 5.
Figure 9:
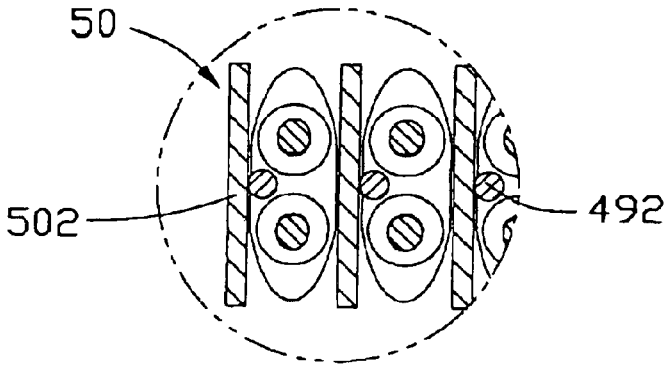
FIG. 9 is an enlarged view of a circled portion of FIG. 8 indicated by reference number 9 thereof.

Referring to FIG. 5 in cooperation with FIG. 1, the pull tab 82 has two arms 822 extending forwardly, each arm 822 forming a mounting block 824 at an inner side of a rear portion thereof and a driving block 86 at the inner side of a front end thereof. A pair of latches 88 is mounted on a front portion of lateral walls of the base 80. Each latch 88 has a hooked front end 884 for latching with the complementary connector when the cable connector 1 in accordance with the present invention mates with the complementary connector, a rear end 882 fixedly secured to the base 80, and a cam portion 886 formed between the hooked front end 884 and the rear end 882. The cam portion 886 has an inner face abutting against the driving block 86 of a corresponding arm 822 of the pull tab 82. The cam portion 886 has an inwardly, rearwards stepped configuration, whereby when the driving block 86 moves rearwards as the pull tab 82 is pulled rearwards, the driving block 86 causes the cam portion 886 and thus the hooked front end 884 to move laterally outwardly, thereby to release the latch between the cable connector 1 in accordance with the present invention and the complementary connector. A pair of leaf springs 84 is provided with the cable connector 1 wherein each spring 84 has a front end fixed in the mounting block 824 of a corresponding arm 822 of the pull tab 82, and a rear end fixed to the base 80. When the pull tab 82 is pulled rearwards, the springs 84 are compressed. When the pulling force is released, the springs 84 return to their original configurations, thereby motivating the pull tab 82 to return to is original position prior to being pulled. Thus, the latches 80 return to their original position as shown in FIG. 5. Concerning more detailed information of the structure, mounting and action of the pull tab 82, the leaf springs 84 and the latches 88, one can refer to the disclosure of the co-pending patent application mentioned in CROSS-REFERENCE TO RELATED APPLICATION of this specification.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable assembly comprising:

a cable including a plurality of lines each including a pair of signal conductors and a ground conductor;

a spacer integrally connected to front portions of the lines to have said lines in a equidistant manner mutually;

a printed circuit board defining opposite top and bottom surfaces with a plurality of signal and ground conductive pads thereon, the signal conductors being fixed to the corresponding signal conductive pads, respectively;

a plurality of shielding metallic plates located between adjacent lines, respectively, for isolation, each of said shielding plates including at least one front finger located above the printed circuit board and fixed to the corresponding ground conductive pad on the printed circuit board, and a rear body portion extending rearwardly from the finger and behind the printed circuit board; wherein the spacer is spatially located behind the printed circuit board, and each of said shielding plates is fully exposed outside of said spacer and mainly held by the printed circuit without contacting with said spacer.

2. The assembly as defined in claim 1, wherein said signal conductive pads and said ground conductive pads are alternately arranged in a row on each of said top and bottom surfaces.

3. The assembly as defined in claim 2, wherein front end of the signal conductors of the lines and the front fingers of the shielding plates are aligned with one another in a lateral direction perpendicular to a front-to-back direction of the printed circuit board.

4. An electrical connector, comprising:

a printed circuit board having a first edge and a second edge;

a plurality of signal and ground conductive pads alternatively arranged along the second edge;

a connector body assembled to the first edge of the printed circuit board;

a plurality of shielding plates each connected to a corresponding ground pad in the second edge by at least one finger extending from the shielding plate; and wherein the printed circuit board dose not include an undercut extending from the second edge for receiving the shielding plate;

further comprising a cable having a plurality of lines therein, the lines and the shielding plates arranged alone the second edge of the printed circuit board in an alternate manner;

wherein each line of the cable comprises a pair of signal conductors connected to corresponding signal pads on second edge of the printed circuit board and a grounding conductor electrically connected with a corresponding shielding plate.

* * * * *